United States Patent [19]

Stewart

[11] 4,337,825

[45] Jul. 6, 1982

[54] HEAT PIPE MANIFOLD HEAT EXCHANGER

[76] Inventor: James M. Stewart, 115 Sylvan Way, Greenville, S.C. 29605

[21] Appl. No.: 231,983

[22] Filed: Feb. 6, 1981

Related U.S. Application Data

[62] Division of Ser. No. 859,977, Dec. 12, 1977, Pat. No. 4,285,394.

[51] Int. Cl.[3] ..... F28D 15/00

[52] U.S. Cl. ..... 165/104.21; 122/33; 165/DIG. 12

[58] Field of Search ..... 165/104.21, DIG. 12; 122/33

[56] References Cited

U.S. PATENT DOCUMENTS

| | | | |
|---|---|---|---|
| 1,619,660 | 3/1927 | Field | 165/104.21 X |
| 1,863,938 | 6/1932 | Smith | 62/333 X |
| 2,013,515 | 9/1935 | Heitman | 165/104.21 X |
| 2,835,480 | 5/1958 | Perez | 165/104.21 X |
| 2,966,033 | 12/1960 | Hughel | 165/104.21 X |
| 3,433,929 | 3/1969 | Snelling | 165/104.21 X |
| 3,788,388 | 1/1974 | Barkmann | 165/104.21 X |
| 4,080,957 | 3/1978 | Bennett | 165/104.21 X |

FOREIGN PATENT DOCUMENTS

| | | | |
|---|---|---|---|
| 3039636 | 8/1956 | Fed. Rep. of Germany | 165/104.21 |
| 1190936 | 10/1959 | France | 165/104.21 |
| 767086 | 1/1957 | United Kingdom | 165/104.21 |
| 526760 | 12/1976 | U.S.S.R. | 165/104.21 |

OTHER PUBLICATIONS

Hughes, *Heatbank*, Electron Dynamics Div., Hughes Aircraft Co., Torrance, Cal. (90509), 10/1975.

*Primary Examiner*—Albert W. Davis
*Attorney, Agent, or Firm*—Dority & Flint

[57] ABSTRACT

A heat exchange apparatus is illustrated, which may be used as in a stream of solar heated air for heating flowing water, wherein an array of heat pipes is utilized in heat exchange relation with a manifold, wherein vapor medium is exchanged therebetween for conducting heat from one to the other.

8 Claims, 4 Drawing Figures

HEAT PIPE MANIFOLD HEAT EXCHANGER

This is a division of application Ser. No. 859,977, filed Dec. 12, 1977, now U.S. Pat. No. 4,285,394, issued on Aug. 25, 1981.

BACKGROUND OF THE INVENTION

Heat pipes have been used in connection with the heating and cooling of various structures. For example, U.S. Pat. No. 3,788,388 illustrates the use of heat pipes in a regenerator to exchange heat between intake air as it flows into an enclosure and exhaust air as it flows out of the enclosure. For this purpose a plurality of sealed heat tubes are disposed in generally parallel relationship, one end being disposed in heat exchange relationship with the intake air and the other being exposed to the exhaust air. The patent illustrates generally, heat tubes of the type which may be employed with the present invention. Suitable heat pipes are also illustrated in U.S. Pat. No. 3,753,364. Heat tubes useful in connection with the present invention may be constructed with or without wicking members and if as illustrated herein, those without wicking members are employed, it is preferred that the horizontal array of heat tubes be tilted slightly toward one end.

An important object of the invention is to provide an improved heat exchange apparatus employing an array of heat tubes all of which have connection with a manifold element so that the array and the manifold are in heat transfer relation.

Another important object of the invention is to provide a heat exchange apparatus which may be especially useful in connection with heating flowing water by means of solar heated air as may be provided by a solar collector so that the air passes through the heat exchange apparatus to transfer heat from the air to the flowing water.

SUMMARY OF THE INVENTION

It has been found that a versatile heat exchange apparatus is capable of efficiently and very rapidly conducting heat from one element to another by providing an array of heat tubes which are connected to a manifold so that vapor may be moved therebetween to effect heat transfer.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
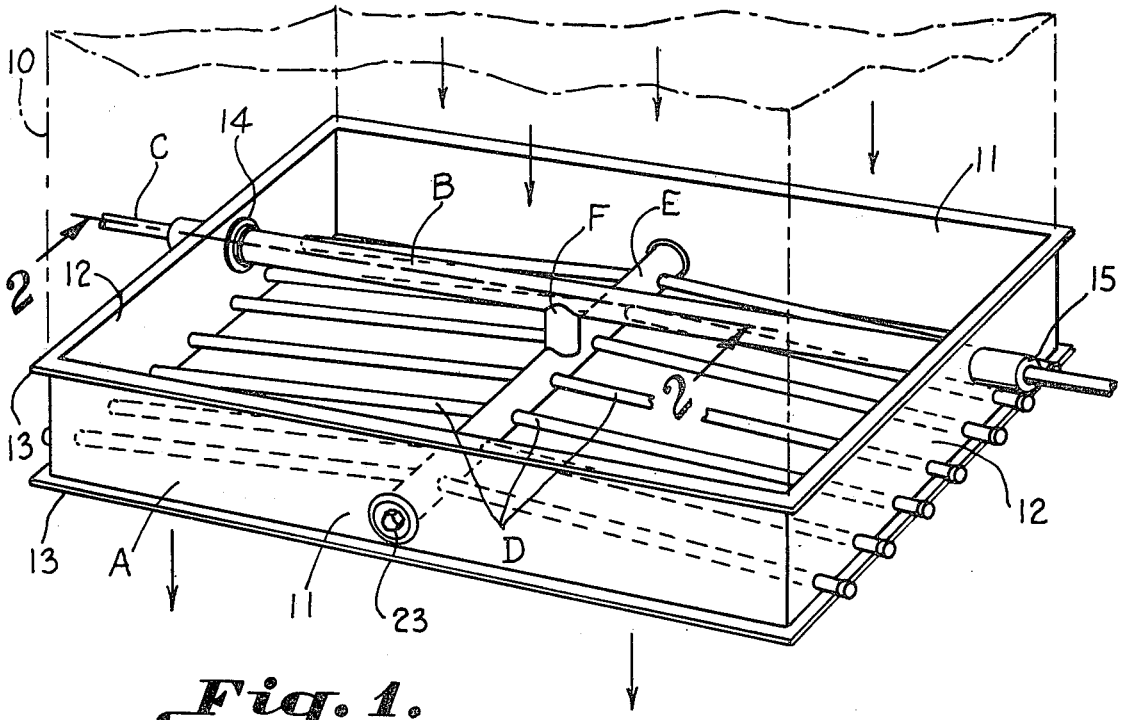
FIG. 1 is a schematic, perspective view illustrating a heat exchange apparatus constructed in accordance with the present invention positioned within the air flow of a duct carrying air from a solar collector.

The drawing illustrates heat exchange apparatus utilized in a stream of solar heated air for heating flowing water. An open frame A accommodates the passage of an air stream therethrough. An elongated manifold B is carried in the frame and a pipe C for carrying flowing water extends longitudinally in heat transfer relation with the manifold in spaced relation thereto. A plurality of spaced heat tubes D have a vaporizable medium therein and are carried in the frame beneath the manifold. Means for collecting vapor from the heat tubes includes a collector pipe E and means for conveying the vapor into the manifold into heat exchange relation to the water within the pipe includes an upright conduit F. If desired, the manifold may be positioned within the water pipe rather than outside as illustrated. Thus, the vapor from the heat tubes condenses in the manifold giving up its latent heat to the water.

While the embodiment of the invention illustrated is described in connection with utilizing solar heated air, it is to be understood that the combination of heat tubes and manifold illustrated and described herein may be adapted to many other uses where heat is transferred from one fluid to another fluid whether gas to gas, gas to liquid, etc.

A duct for carrying heated air from a solar collector is illustrated in broken lines in FIG. 1 and is designated at 10. The duct 10 carries downwardly flowing air, as illustrated by the arrows in FIG. 1. In the embodiment illustrated in FIGS. 1 and 2, the vaporizable medium in the heat tubes takes on heat from the solar heated air and the vapor formed thereby is collected in the collector pipe and passes through the upright conduit or stand pipe F into the manifold where it gives up its latent heat to the water contained within the pipe which passes longitudinally therethrough.

The open frame A is illustrated in the form of a rectangular member having vertical sides 11 and ends 12 with horizontal upper and lower flanges 13 which are suitably secured within the duct 10. An elongated manifold B is carried longitudinally of the frame between the end walls 12, and is positioned within an upper portion thereof as by a suitable flanged support 14. The manifold is capped at each end as at 15. The cap 15 serves as a positioning member and support for a pipe C which is illustrated in the drawing as carrying water from a suitable source in the direction of the arrows in FIG. 2 from the inlet end of the left-hand side to an outlet end on the right-hand side. It is possible that the liquid carrying pipe C may be provided with internal or external thermal fins. A space 17 around the fins 16 about the pipe C is provided within the manifold B.

Figure 2:
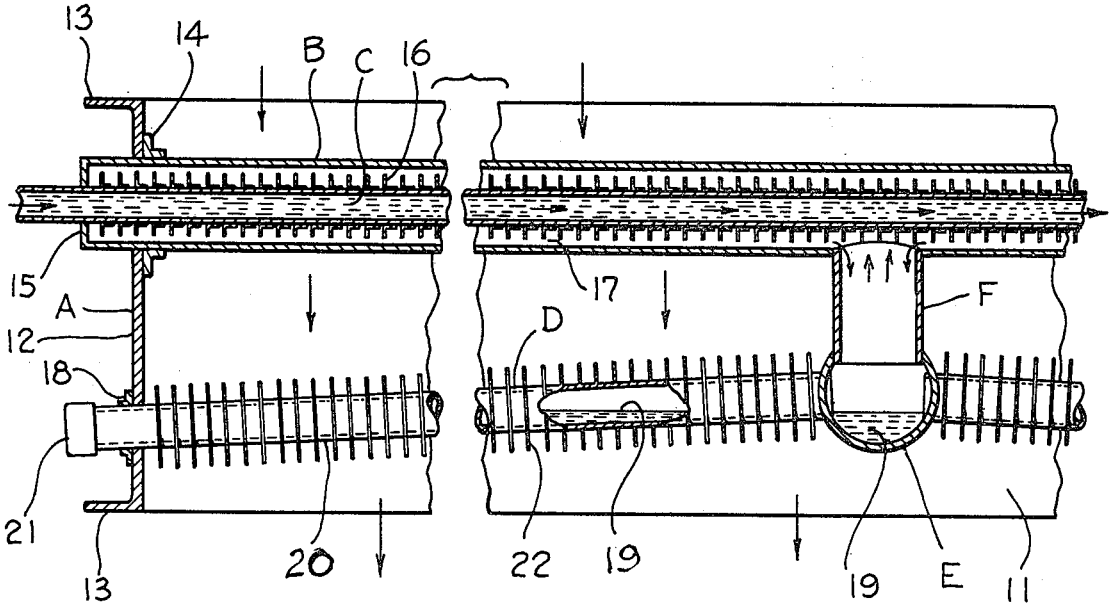
FIG. 2 is an enlarged longitudinal sectional elevation taken on the line 2—2 in FIG. 1, with parts broken away and parts omitted.

Beneath the manifold, an array of generally horizontal heat tubes are illustrated at D being positioned on each side of a collector pipe E. The heat pipes are supported on one end by the collector pipe E, and on the other end as by a suitable fitting 18 within the end walls 12 of the frame A. The heat tubes D comprise the usual pipe member 20 which carries a vaporizable medium 19 therein which communicates with the fluid or vapor 19 within the collector pipe E. The end of the heat pipes opposite the fitting 18 are connected in fluid flow relationship with the collector pipe E and the adjacent end of the heat pipes open into the collector E to permit flow of vapor or liquid phase vaporizable material, or both. The other ends of the heat pipes are closed and capped as illustrated at 21. These ends of the collector pipe E are supported within the frame sides 11 and are capped as illustrated at 23. Preferably, the heat pipes D are provided with suitable thermal fins as illustrated at 22. Means is provided for connecting the collector pipe E to the manifold B as by a stand pipe or vertical conduit F. As illustrated in FIG. 2, the vapor phase of the heat transfer medium is shown ascending centrally of stand pipe F by upward arrows, while the liquid phase flows downwardly adjacent the inside walls of the pipe F.

It is to be understood that any suitable type of working fluid medium may be employed in connection with the heat pipes and manifold as, for example, one of the Freons or a variety of organic fluids such as methanol or even Hydrogen may be employed for cryogenic applications. If difficulty is experienced in carrying out the evaporation and condensation phases to accommodate vapor and liquid flow of the heat transfer medium, suitable wicks or baffles or other desirable means may be employed. Also, a preferred material compatible with the liquid and the medium, such as copper, may be utilized in connection with the various heat transfer elements and since in the embodiment illustrated, building structure applications are contemplated, it may be preferable that the liquid vapor medium may be of a non freezing variety. It may be possible to run the water pipe directly through a pipe such as the collector pipe E which would then serve as a manifold pipe. In the embodiment shown the collector pipe, the stand pipe and the manifold all serve as manifold means for receiving heat transfer medium from the heat pipes.

It is to be especially noted that by inverting the heat exchange apparatus illustrated so that the water pipe and manifold is below the heat pipe array, that the system may be made to work in reverse, that is to heat gas with a hot liquid. In such a system, heat is transferred from the fluid such as water, to gas such as air.

Figure 3:
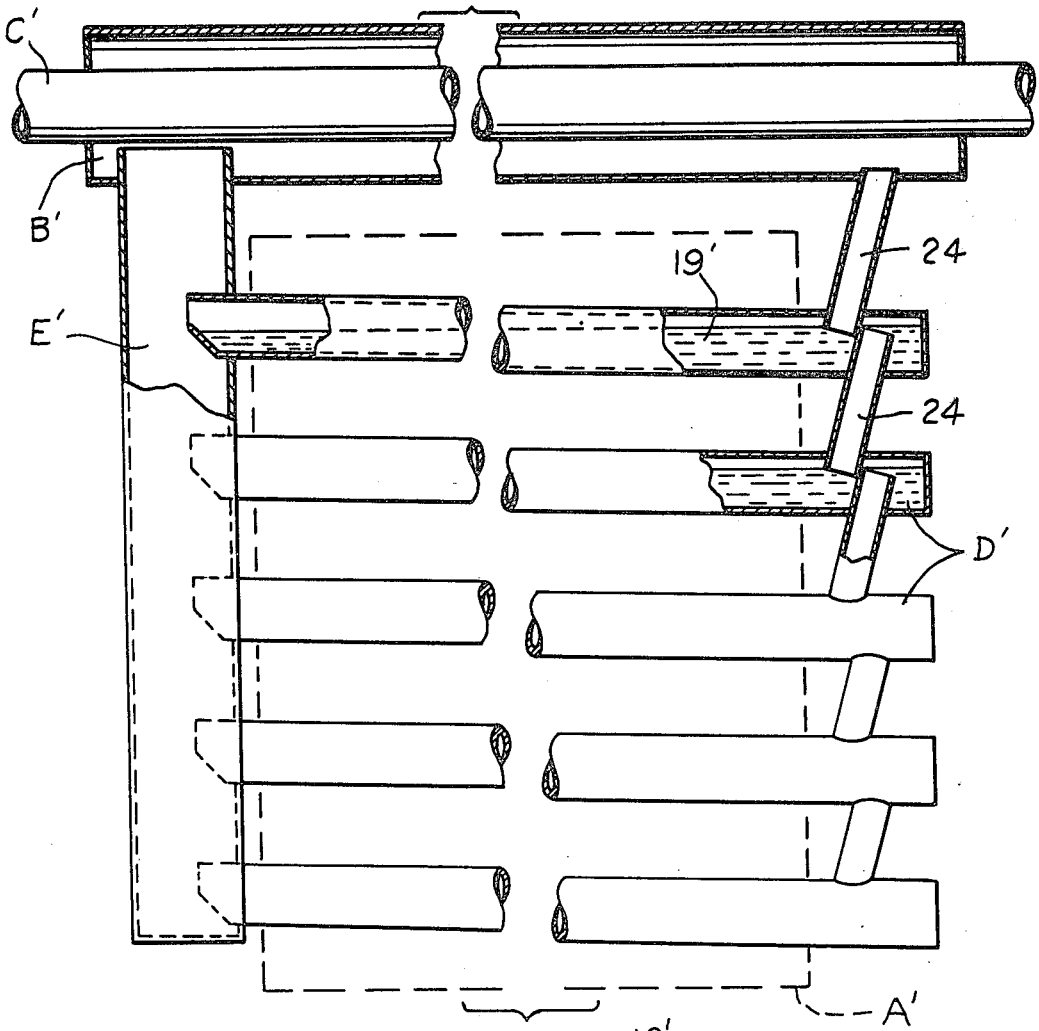
FIG. 3 is a schematic front elevation, with parts broken away, illustrating a modified embodiment of the invention.

While the various components of heat transfer apparatus have been illustrated being disposed generally horizontally, it is to be understood that the elements may be otherwise disposed as, for example, the heat pipe arrays may be arranged vertically so that they are vertically spaced along a collector pipe such as the pipe E′ in FIG. 3. A vertical frame A′ is illustrated schematically in broken lines in FIG. 3 for carrying a horizontal flow of heated air. In this embodiment, it is necessary to provide overflow connections 24 between the ends of the vertically spaced heat pipes D′ remote from the collector pipe so as to maintain a desired liquid level in all the pipes. In this embodiment the collector pipe serves also as a stand pipe. The pipes 24 are offset with respect to adjacent pipes in vertical alignment.

Figure 4:
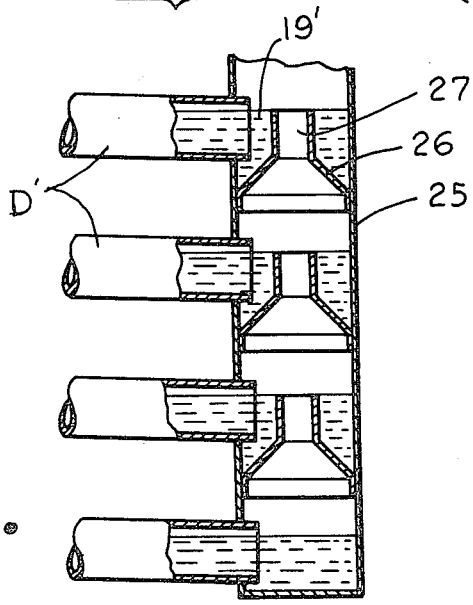
FIG. 4 is a front elevation, with parts broken away, illustrating a further modified embodiment of the invention.

FIG. 4 illustrates a further modified embodiment wherein vertically spaced heat pipes D′ are employed with overflow means arranged in a vertical overflow pipe 25. The overflow means include a liquid trap formed from a baffle 26 which has an upper extension 27 serving as an overflow pipe to maintain the proper level of the medium 19′ in the heat pipe D′.

While a preferred embodiment of the invention has been described using specific terms, such description is for illustrative purposes only, and it is to be understood that changes and variations may be made without departing from the spirit or scope of the following claims.

What is claimed is:

1. Heat pipe manifold heat exchange apparatus for exchanging heat between first and second heat exchange media comprising:

frame means having closed sides and open opposed faces through which a flow of said first medium is delivered;

a plurality of heat tubes carried by said frame means exposed to said first medium flow having a vaporizable heat transfer medium therein;

collector means connected to said heat tubes adjacent one end thereof receiving vaporized heat transfer medium therefrom;

manifold means communicating with said collector means, said manifold means including means for conveying a flow of said second heat transfer medium therethrough; and overflow means connected between adjacent ends of said heat tubes remote from said collector means for returning said condensed heat transfer medium to said heat tubes and maintaining a desired level of said heat transfer medium therein;

whereby vaporized heat transfer medium from the heat tubes condenses in said manifold transferring its latent heat to said second medium therein.

2. The apparatus of claim 1 wherein said heat tubes are spaced at differene levels and carried beneath the manifold; and said collector means includes an upright collector communicating with an open end of said heat pipes and with said manifold.

3. The apparatus of claim 2 wherein said overflow means includes pipes connecting said heat tubes being offset with respect to next adjacent pipes.

4. The apparatus of claim 2 wherein said overflow means includes an upright overflow pipe with liquid traps vertically spaced therein, and an overflow pipe in each liquid trap through which condensed heat transfer medium overflows into a next adjacent heat tube.

5. Heat pipe manifold heat exchange apparatus for exchanging heat between a gas and a liquid comprising:

frame means having side peripheral walls defining opposed open faces through which a flow of said gas is delivered;

elongated manifold means;

a liquid delivery pipe carried within said manifold means in spaced relation thereto adapted for carrying a flowing liquid therethrough;

a plurality of spaced heat tubes having a vaporizable heat transfer medium therein carried within said frame means exposed to said flow of gas thereacross;

collector means communicating with said manifold means and connected in common with ends of said heat tubes for collecting vaporized heat transfer medium therefrom and conveying same to said manifold means; and return means connected to said heat tubes remote from said collector means returning condensed heat transfer medium from said manifold means to said heat tubes and serving to maintain said level of liquid medium uniformly in each of said heat tubes at a desired level for efficient vaporization therein.

6. The apparatus of claim 5 wherein said heat pipes are inclined relative to said collector means so that said desired level of said liquid medium only partially fills said individual heat tubes along their entire length enhancing vaporization.

7. The apparatus of claim 5 wherein said return means includes overflow means conveying condensed heat transfer medium over into the next adjacent heat tube to maintain said desired level of heat transfer medium in said heat tubes.

8. The apparatus of claim 7 wherein said heat tubes are spaced at different levels.

* * * * *